US008347832B2

(12) United States Patent
Adams

(10) Patent No.: US 8,347,832 B2
(45) Date of Patent: Jan. 8, 2013

(54) FUEL SUPPLY AND COMBUSTION CHAMBER SYSTEMS FOR FASTENER-DRIVING TOOLS

(75) Inventor: Joseph S. Adams, Salt Spring Island (CO)

(73) Assignee: Illinois Tool Works Inc., Glenview, IL (US)

( * ) Notice: Subject to any disclaimer, the term of this patent is extended or adjusted under 35 U.S.C. 154(b) by 686 days.

(21) Appl. No.: 12/289,633

(22) Filed: Oct. 31, 2008

(65) Prior Publication Data

US 2010/0108734 A1 May 6, 2010

Related U.S. Application Data

(63) Continuation-in-part of application No. 12/084,963, filed on Mar. 4, 2009.

(51) Int. Cl.
*F02B 71/00* (2006.01)

(52) U.S. Cl. ..... 123/46 R; 30/523; 123/46 SC

(58) Field of Classification Search ..... 123/46 R, 123/46 SC, 46 H, 179.16, 73 R; 30/381, 30/523, 216

See application file for complete search history.

(56) References Cited

U.S. PATENT DOCUMENTS

| | | | | |
|---|---|---|---|---|
| 2,435,232 | A | 2/1948 | Morain | |
| 3,352,545 | A | 11/1967 | Denine | |
| 3,722,481 | A | 3/1973 | Braun | |
| 4,013,396 | A * | 3/1977 | Tenney | 431/11 |
| 4,088,104 | A | 5/1978 | Ibbott | |
| 4,094,275 | A * | 6/1978 | Auiler et al. | 123/549 |
| 4,152,121 | A | 5/1979 | van der Weide et al. | |
| 4,399,079 | A * | 8/1983 | Lowe | 261/36.2 |
| 4,773,361 | A * | 9/1988 | Toki et al. | 123/90.23 |
| 4,821,683 | A | 4/1989 | Veldman | |
| 4,905,634 | A | 3/1990 | Veldman | |
| 4,997,598 | A | 3/1991 | Aleem-Uddin | |
| 5,000,128 | A * | 3/1991 | Veldman | 123/46 SC |
| 5,213,247 | A | 5/1993 | Gschwend et al. | |
| 5,701,855 | A * | 12/1997 | Kurihara et al. | 123/73 AD |
| 5,826,428 | A * | 10/1998 | Blaschke | 60/303 |
| 6,189,516 | B1 | 2/2001 | Hei Ma | |
| 6,526,926 | B1 | 3/2003 | Towfighi | |
| 6,634,325 | B1 | 10/2003 | Adams | |
| 6,647,969 | B1 | 11/2003 | Adams | |
| 6,805,105 | B2 * | 10/2004 | Kato et al. | 123/514 |
| 6,843,401 | B2 | 1/2005 | Favre-Bulle | |
| 6,912,988 | B2 | 7/2005 | Adams | |
| 6,988,469 | B2 | 1/2006 | Schiestl et al. | |
| 7,281,502 | B2 * | 10/2007 | Hurlstone et al. | 123/46 SC |
| 7,798,383 | B2 * | 9/2010 | Liesse | 227/9 |

(Continued)

FOREIGN PATENT DOCUMENTS

| | | |
|---|---|---|
| CN | 2374653 | 3/2000 |

(Continued)

*Primary Examiner* — Nathaniel Wiehe
*Assistant Examiner* — Long T Tran
(74) *Attorney, Agent, or Firm* — Law Offices of Steven W. Weinrieb

(57) ABSTRACT

A fuel supply and combustion chamber system for a portable power tool, such as, for example, a fastener-driving tool, wherein the fuel supply and combustion chamber system can utilize liquid or gaseous fuels. The fuel supply and combustion chamber system can comprise multiple combustion chambers for achieving predetermined combustion and power output characteristics. In addition, the fuel supply and combustion chamber system can utilize portioning valve structures for providing predetermined amounts of either a gaseous or liquid fuel into the portable power tool combustion chamber.

10 Claims, 10 Drawing Sheets

U.S. PATENT DOCUMENTS

| | | | | |
|---|---|---|---|---|
| 2001/0020453 | A1 | 9/2001 | Bailey | |
| 2001/0032601 | A1 * | 10/2001 | Galka et al. | 123/73 A |
| 2003/0177768 | A1 * | 9/2003 | Pellizzari | 60/737 |
| 2004/0065277 | A1 | 4/2004 | Schaeffer | |
| 2004/0079302 | A1 | 4/2004 | Wolf et al. | |
| 2004/0112309 | A1 | 6/2004 | Odoni et al. | |
| 2004/0187810 | A1 | 9/2004 | Gschwend et al. | |
| 2005/0000711 | A1 * | 1/2005 | Hurlstone et al. | 173/19 |
| 2005/0120983 | A1 | 6/2005 | Adams | |

FOREIGN PATENT DOCUMENTS

| | | |
|---|---|---|
| CN | 2469196 | 1/2002 |
| JP | 60-120114 | 6/1985 |
| JP | 62-44170 | 9/1987 |
| JP | 63-207569 | 8/1988 |
| JP | 4-261783 | 9/1992 |
| JP | 08-338595 | 12/1996 |
| JP | 2001-162561 | 6/2001 |
| JP | 2004-34288 | 2/2004 |

* cited by examiner

FUEL SUPPLY AND COMBUSTION CHAMBER SYSTEMS FOR FASTENER-DRIVING TOOLS

CROSS-REFERENCE OF RELATED PATENT APPLICATION

This patent application is a Continuation-in-Part of United States patent application entitled FUEL SUPPLY AND COMBUSTION CHAMBER SYSTEMS FOR FASTENER-DRIVING TOOLS which was filed on Mar. 4, 2009 and which has been assigned Ser. No. 12/084,963.

FIELD OF THE INVENTION

The present invention relates generally to portable power tools, and more particularly to new and improved fuel supply and combustion chamber systems for such portable power tools, such as, for example, fastener-driving tools.

BACKGROUND OF THE INVENTION

Portable power tools having various different means for conducting or charging a combustible fuel into a suitable combustion chamber are of course well-known. An example of such a portable power tool is disclosed within U.S. Pat. No. 4,905,634 which issued to Veldman on Mar. 6, 1990. In accordance with the particular structure comprising the portable power tool of Veldman, the portable power tool disclosed therein utilizes any one of various gaseous fuels, such as, for example, compressed natural gas, a liquid petroleum gas, butane, or the like, and in order to effectively predetermine the rate at which the gaseous fuel is supplied to the power tool combustion chamber, a manually controlled adjusting screw or metering valve is utilized for the fine adjustment of the incoming gas supply. In addition, the introduction of the incoming gaseous fuel, as determined by means of the aforenoted manually controlled adjusting screw or metering valve, is also utilized to effectively induce or entrain the flow of ambient air into the combustion chamber of the power tool either for scavenging purposes in connection with residual gases that will be present within the combustion chamber upon completion of a particular power tool firing cycle, or for charging purposes in connection with the initiation of a subsequent power tool firing cycle. While the portable power tools, as exemplified by means of the portable power tool disclosed within the Veldman patent, are generally satisfactory, it is noted that such portable power tools nevertheless do exhibit some operational drawbacks or limitations.

For example, as has been noted hereinbefore, such portable power tools are adapted for use in connection with gaseous fuels, not liquid fuels, however, it is often desirable to operate such portable power tools, or similar portable power tools, with liquid fuels. In addition, while the aforenoted manually controlled adjusting screw or metering valve can predetermine the rate at which the gaseous fuel is supplied to the power tool combustion chamber, it is important that a predetermined amount of the fuel be supplied into the power tool combustion chamber so as to achieve proper or more accurate stoichiometric air-fuel ratios. Still yet further, portable power tools such as those disclosed within Veldman are not concerned with multiple combustion chamber systems which are desired or required for achieving predetermined combustion and power output characteristics or parameters.

A need therefore exists in the art for a new and improved fuel supply and combustion chamber system for a portable power tool, such as, for example, a fastener-driving tool, wherein the fuel supply and combustion chamber system can utilize liquid fuels, wherein the fuel supply and combustion chamber system can comprise multiple combustion chamber systems for achieving predetermined combustion and power output characteristics or parameters, and wherein the fuel supply and combustion chamber system can utilize portioning valve structures for providing predetermined amounts of either a gaseous or liquid fuel into the portable power tool combustion chamber.

SUMMARY OF THE INVENTION

The foregoing and other objectives are achieved in accordance with the teachings and principles of the present invention through the provision of a first embodiment of a new and improved fuel supply and combustion chamber system for a portable power tool which comprises the use of, for example, a liquefied liquid petroleum gas fuel supply as the portable power tool fuel source, and an evaporator which may be, for example, incorporated within the handle or housing structure of the power tool so as to effectively be in thermal communication with a suitable heat source whereby the heat source can serve to cause the evaporation of the liquefied liquid petroleum gas thereby converting the same into a gaseous fuel. The suitable heat source may either be, for example, the ambient environment, or heat generated by and transmitted from the power tool combustion chamber. A portioning valve is preferably interposed between and operatively associated with both the liquefied liquid petroleum gas fuel supply and the evaporator so as to supply a predetermined amount or portion of the liquefied liquid petroleum gas from the liquefied liquid petroleum gas fuel supply to the evaporator.

In accordance with additional principles and teachings of the present invention, there is provided a second embodiment of a new and improved fuel supply and combustion chamber system for a portable power tool which comprises the use of multiple combustion chambers for achieving predetermined combustion and power output characteristics or parameters, wherein the same comprises, for example, a first precombustion chamber and a second main combustion chamber, a bypass valve interposed between and fluidically connecting the first and second combustion chambers together under exhaust gas scavenging or purging conditions, and a jet pump disposed upstream of the first pre-combustion chamber for admitting a predetermined charge or amount of fuel into the first pre-combustion chamber and for inducing or entraining air into the predetermined charge or amount of fuel for mixing therewith in order to form an air-fuel mixture having a predetermined stoichiometric ratio. A check valve is operatively associated with an orifice so as to control the fluidic communication between the first pre-combustion chamber and the second main combustion chamber, or alternatively, in accordance with the principles and teachings of a first modified embodiment of the second embodiment of the new and improved fuel supply and combustion chamber system for a portable vapor tool, the check valve may effectively be eliminated thereby permitting constant or permanent communication between the first pre-combustion chamber and the second main combustion chamber.

In this manner, greater air-fuel mixture ratios are permitted, and the total volumetric capacity of the multiple combustion chambers is effectively increased thereby advantageously affecting the vacuum volume and return stroke characteristics of the tool upon completion of a fastener firing cycle. Continuing still further, in accordance with the principles and teachings of second and third modified embodiments of the second embodiment of the new and improved fuel supply and combustion chamber system for a portable power tool, while both the first pre-combustion chamber and the second main combustion chamber are fluidically connected together by means of the aforenoted check valve or simply by means of one or more orifices, the bypass valve is effectively eliminated and the first pre-combustion chamber and the second main combustion chamber are respectively provided with separate fuel supplies, separate intake valves, and separate exhaust valves. This arrangement permits advantageous speed of operation, enhanced pressure conditions, and reduced downstream resistance to be developed within the power tool. In accordance with still additional principles and teachings of the present invention, there is provided a third embodiment of a new and improved fuel supply and combustion chamber system for a portable power tool which comprises the use of a gaseous liquid petroleum gas fuel supply as the fuel source for the portable power tool, and a portioning valve interposed between the gaseous liquid petroleum gas fuel supply and a jet pump disposed upstream of the portable power tool combustion chamber. In this manner, a predetermined portion or amount of the gaseous liquid petroleum gas fuel is supplied from the gaseous liquid petroleum gas fuel supply to the jet pump and into the combustion chamber of the power tool. Alternatively, in accordance with a fourth embodiment of the present invention, a metering valve may be utilized for supplying the gaseous liquid petroleum gas fuel toward the jet pump and the combustion chamber of the power tool, and an electrically timed pulse supply controller is operatively associated with the metering valve for effectively converting the same from a metering valve, for determining the flow rate of the fuel passing therethrough, to a portioning valve for determining the amount of the fuel passing therethrough.

Lastly, in accordance with still further principles and teachings of the present invention, there is provided a first modified embodiment of the first embodiment of the new and improved fuel supply and combustion chamber system for a portable power tool wherein the portioning valve is operatively controlled by means of a workpiece contact element which is mounted upon the power tool so as to be adapted to be engaged with or disengaged from a workpiece into which a fastener is to be driven, and wherein further, the trigger mechanism of the power tool is operatively connected to the intake and exhaust valves of the combustion chamber as well as to a piezoelectric spark generator. The fuel supply for this fuel supply and combustion chamber system of the portable power tool may comprise either a liquefied liquid petroleum gas fuel supply as controlled by means of a portioning valve mechanism, or alternatively, a gaseous liquid petroleum gas fuel supply as controlled by means of a portioning valve mechanism.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
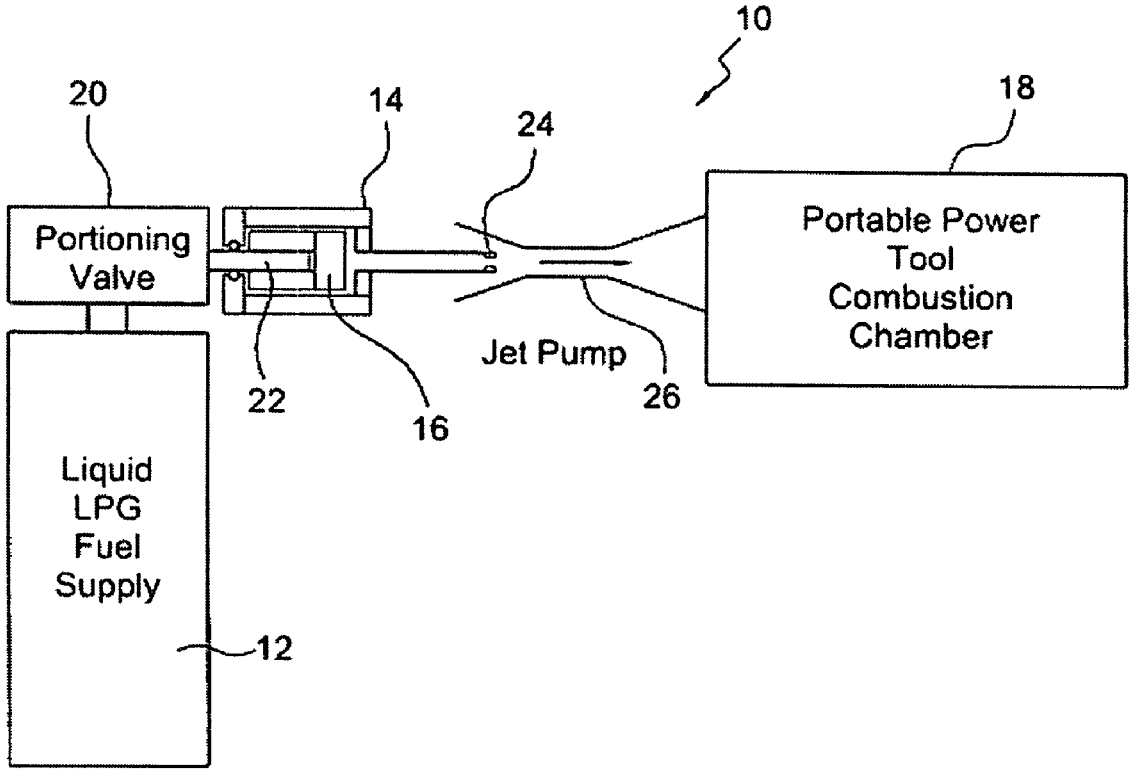
FIG. 1 is a schematic drawing illustrating a first embodiment of a new and improved fuel supply and combustion chamber system for a portable power tool, constructed in accordance with the principles and teachings of the present invention, wherein the same comprises the use of, for example, a liquefied liquid petroleum gas fuel supply as the portable power tool fuel source, an evaporator for evaporating the liquefied liquid petroleum gas and thereby converting the same into a gaseous fuel for admission into the combustion chamber of the portable power tool, and a portioning valve interposed between and operatively associated with the liquefied liquid petroleum gas fuel supply and the evaporator so as to supply a predetermined amount or portion of the liquefied liquid petroleum gas from the liquefied liquid petroleum gas fuel supply to the evaporator.

Referring now to the drawings, and more particularly to FIG. 1 thereof, a first embodiment of a new and improved fuel supply and combustion chamber system, for a portable power tool, as constructed in accordance with the principles and teachings of the present invention, is disclosed and is generally indicated by the reference character 10. More particularly, it is seen that the first embodiment new and improved fuel supply and combustion chamber system 10 for a portable power tool comprises a liquefied liquid petroleum gas fuel supply 12 as the fuel source for the portable power tool, and an evaporator 14, comprising a sintered bronze element 16, for effectively evaporating the liquefied liquid petroleum gas fuel and thereby converting the same into a gaseous liquid petroleum gas fuel for admission into the combustion chamber 18 of the portable power tool. In addition, a portioning valve 20 is interposed between, and is operatively and fluidically connected with, both the liquefied liquid petroleum gas fuel supply 12 and the evaporator 14. In this manner, the portioning valve 20 receives liquefied liquid petroleum gas from the liquefied liquid petroleum gas fuel supply 12, and when the nozzle portion 22 of the portioning valve 18 is moved relative to the evaporator 14, a predetermined portion or amount of the liquefied liquid petroleum gas fuel is discharged toward and into or onto the sintered bronze element 16 of the evaporator 14. The evaporator 14 is adapted to be disposed or incorporated within, for example, the handle portion or other structural component of the portable power tool housing so as to effectively be disposed in thermal communication either with the ambient environment or the combustion chamber 18 of the portable power tool so as to effectively evaporate the predetermined portion of the liquefied liquid petroleum gas fuel dispensed from the portioning valve 20. Accordingly, when the evaporator 14 achieves the aforenoted evaporation of the liquefied liquid petroleum gas fuel and effectively converts the same into a gaseous liquid petroleum gas fuel, the gaseous liquid petroleum gas fuel will, in turn, be dispensed from the discharge orifice 24 of the evaporator 14 into a jet pump mechanism 26 which is interposed between the evaporator 14 and the combustion chamber 18 of the portable power tool. The jet pump mechanism 26 comprises, in effect, a venturi-type device that effectively induces or entrains air into the gaseous liquid petroleum gas fuel being dispensed or discharged by means of the evaporator 14 toward the combustion chamber 18 of the portable power tool so as to permit the induced or entrained air to mix with the aforenoted gaseous liquid petroleum gas fuel being conducted or conveyed into the combustion chamber 18 of the portable power tool. As a result of the aforenoted structure characteristic of the first embodiment new and improved fuel supply and combustion chamber system 10 for a portable power tool, the portable power tool may be operated with liquid fuel, and in addition, the employment of the portioning valve 20 within the system 10 permits a predetermined amount of the fuel be supplied into the portable power tool combustion chamber 18 so as to achieve a proper or more accurate stoichiometric air-fuel mixture ratio.

Figure 2A:
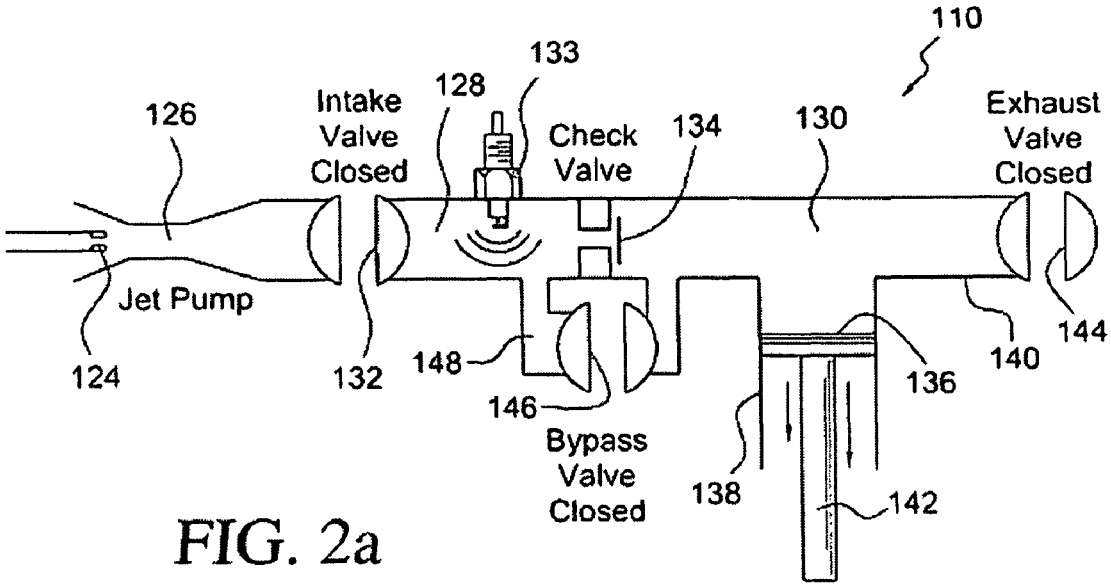
FIGS. 2*a* and 2*b* are schematic views illustrating a second embodiment of a new and improved fuel supply and combustion chamber system for a portable power tool, as constructed in accordance with the principles and teachings of the present invention, wherein the same comprises the use of multiple combustion chambers comprising, for example, a first pre-combustion chamber and a second main combustion chamber, a bypass valve interposed between and fluidically connecting the first and second combustion chambers together under exhaust gas scavenging or purging conditions, as illustrated within FIG. 2*b*, and a jet pump disposed upstream of the first pre-combustion chamber for admitting a predetermined charge or amount of fuel into the first pre-combustion chamber and for inducing or entraining air into the predetermined charge or amount of fuel for mixing therewith in order to form an air-fuel mixture having a predetermined stoichiometric ratio.
Figure 2B:
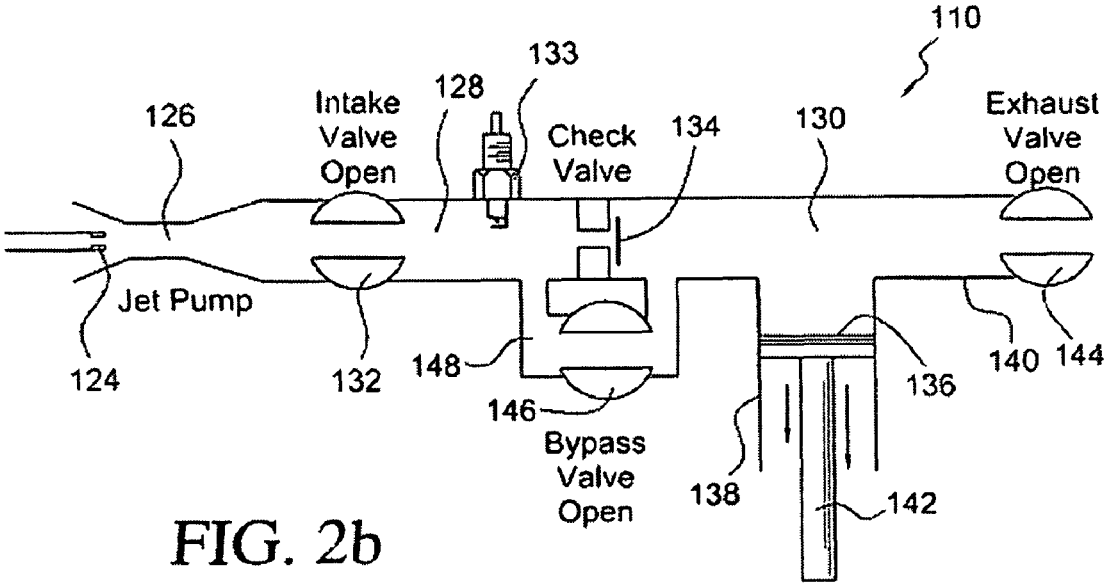

With reference now being made to FIGS. 2*a* and 2*b*, a second embodiment of a new and improved fuel supply and combustion chamber system for a portable power tool, as constructed in accordance with the principles and teachings of the present invention, is disclosed and is generally indicated by the reference character 110. It is to be noted that, in connection with the detailed description of the second embodiment fuel supply and combustion chamber system 110 for a portable power tool, the description will focus upon the particular structure characteristic of such second embodiment fuel supply and combustion chamber system 110, however, structural components of such second embodiment fuel supply and combustion chamber system 110, which are similar or correspond to structural components of the first embodiment fuel supply and combustion chamber system 10 as disclosed within FIG. 1, will be designated by similar or corresponding reference characters except that they will be within the 100 series. More particularly, it is seen that, in accordance with the principles and teachings of the present invention, the second embodiment fuel supply and combustion chamber system 110 comprises the use of multiple combustion chambers so as to achieve predetermined combustion and power output characteristics or parameters. Accordingly, it is seen that the second embodiment fuel supply and combustion chamber system 110 comprises a first pre-combustion chamber 128 and a second main combustion chamber 130.

A jet pump 126, which receives gaseous liquid petroleum gas fuel from a discharge orifice 124 and which also induces or entrains air for mixing with the gaseous liquid petroleum gas fuel and for forming an air-fuel mixture having a predetermined stoichiometric mixture ratio, is adapted to be fluidically connected to the upstream end portion of the first pre-combustion chamber 128 through means of a first, two-position intake valve mechanism 132. An ignition device, such as, for example, a spark plug 133, is disposed within the first pre-combustion chamber 128 for igniting the air-fuel mixture, and it is seen that a check valve mechanism 134 is interposed between, and fluidically interconnects, the first and second pre-combustion and main combustion chambers 128,130 during an ignition, firing, and combustion operational cycle of the portable power tool as illustrated within FIG. 2*a*. A working piston 136 is movably disposed within a working cylinder 138 which is fluidically connected to the second main combustion chamber 130 through means of a side wall portion 140 thereof, and when the portable power tool comprises, for example, a fastener-driving tool, a driver blade 142 or similar fastener-driving member is fixedly connected to the working piston 136. Still further, it is also seen that the downstream end portion of the second main combustion chamber 130 is provided with a second two-position exhaust valve 144, and in accordance with still additional principles and teachings of the present invention, a third two-position bypass valve 146 is disposed within a bypass passageway 148 so as to be interposed between, and fluidically interconnect, the first and second pre-combustion and main combustion chambers 128,130 during an exhaust gas scavenging or purging operational cycle of the portable power tool as illustrated within FIG. 2*b*.

More particularly, in connection with the operation of the second embodiment fuel supply and combustion chamber system 110 for a portable power tool, when an ignition, firing, and combustion operational cycle of the portable power tool is to be initiated, the first intake valve 132, the second exhaust valve 144, and the third bypass valve 146 are initially disposed at their OPEN positions, as illustrated within FIG. 2*b*, so as to admit or charge a predetermined stoichiometric air-fuel mixture into the pre-combustion and main combustion chambers 128,130 from the jet pump 126, and subsequently, the first intake valve 132, the second exhaust valve 144, and the third bypass valve 146 are simultaneously moved to their CLOSED positions, as illustrated within FIG. 2*a*, in order to effectively entrap the air-fuel mixture within the pre-combustion and main combustion chambers 128,130. Subsequently, still further, ignition of the air-fuel mixture within the first primary combustion chamber 128 is initiated by means of the spark plug 133, and as a result of the consequent buildup in pressure within the first pre-combustion chamber 128, the check valve mechanism 134 is forced toward its OPEN position whereby the main or primary combustion of the air-fuel mixture will now occur within the second main combustion chamber 130, so as to operatively drive the working piston 136, in accordance with well-known principles as are more fully set forth, for example, within U.S. Pat. No. 6,912,988 which issued to Adams on Jul. 5, 2005, the disclosure of which is hereby incorporated herein by reference.

Upon completion of the power tool firing cycle, it is desirable to scavenge or purge the exhaust gases present within the first and second pre-combustion and main combustion chambers 128,130 which would normally be achieved under relatively high pressure conditions in order to activate or force open the check valve mechanism 134, however, under such relatively low pressure conditions attendant the use of the jet pump 126, such an operational procedure is not available. Accordingly, the provision of the third bypass valve 146 resolves this problem, and therefore, when the exhaust gas scavenging or purging operation is to be performed, the first intake valve 132, the second exhaust valve 144, and the third bypass valve 146 are simultaneously moved back to their OPEN positions as illustrated within FIG. 2*b*, and as a result of an air-fuel mixture again being charged into the first pre-combustion chamber 128 from the jet pump 126, the air-fuel mixture will flow through the first intake valve 132, through the pre-combustion chamber 128, through the bypass passageway 148 and the bypass valve 146, through the second main combustion chamber 132, and outwardly through the second exhaust valve 144, thereby entraining and exhausting the residual exhaust gases or products disposed within the first pre-combustion and second main combustion chambers 128,130.

Figure 3A:
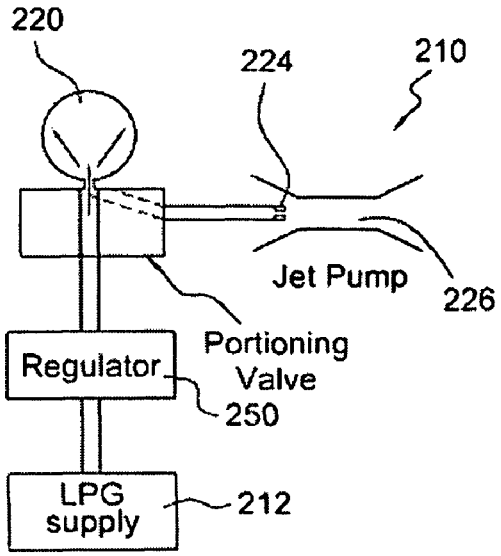
FIGS. 3*a* and 3*b* are schematic views illustrating a third embodiment of a new and improved fuel supply and combustion chamber system for a portable power tool, as has been constructed in accordance with the principles and teachings of the present invention, wherein the same comprises the use of a gaseous liquid petroleum gas fuel supply as the portable power tool fuel source, and a portioning valve which is interposed between the gaseous liquid petroleum gas fuel supply and a jet pump disposed upstream of the portable power tool combustion chamber, and which is movable between two alternative positions, as respectively illustrated within FIGS. 3*a* and 3*b*, such that a predetermined amount or portion of the gaseous liquid petroleum gas fuel may be supplied from the gaseous liquid petroleum gas fuel supply to the jet pump and into the combustion chamber of the power tool.
Figure 3B:
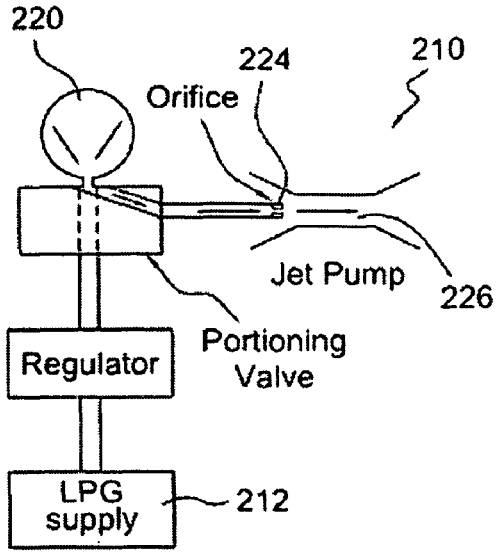

With reference now being made to FIGS. 3*a* and 3*b*, a third embodiment of a new and improved fuel supply and combustion chamber system for a portable power tool, as has been constructed in accordance with the principles and teachings of the present invention, is disclosed and is generally indicated by the reference character 210. As was the case with the second embodiment fuel supply and combustion chamber system 110 for a portable power tool, as disclosed within FIGS. 2*a* and 2*b*, it is likewise to be noted that, in connection with the detailed description of the third embodiment fuel supply and combustion chamber system 210 for a portable power tool, the description will focus upon the particular structure characteristic of such third embodiment fuel supply and combustion chamber system 210, however, structural components of such third embodiment fuel supply and combustion chamber system 210, which are similar or correspond to structural components of the first and second embodiment fuel supply and combustion chamber systems 10,110 as disclosed within FIGS. 1,2*a*,2*b*, will be designated by similar or corresponding reference characters except that they will be within the 200 series. More particularly, it is seen that, in accordance with the principles and teachings of the present invention, the third embodiment fuel supply and combustion chamber system 210 comprises a gaseous liquid petroleum gas fuel supply 212 and a portioning valve 220 which may be operationally similar to the portioning valve 20 as disclosed in connection with the first embodiment fuel supply and combustion chamber system 10, as disclosed within FIG. 1, in that the same will provide a predetermined amount or portion of the gaseous liquid petroleum gas fuel toward a jet pump 226, however, it is seen that the portioning valve 220 is rotatably mounted between a first position, as illustrated at solid lines within FIG. 3*a*, and a second position as illustrated at solid lines within FIG. 3*b*.

When the portioning valve 220 is therefore disposed at its first position as illustrated within FIG. 3*a*, the portioning valve 220 will be disposed in fluidic communication with a suitable pressure regulator 250, which is operatively associated with the gaseous liquid petroleum gas fuel supply 212 so as to regulate the pressure of the gaseous liquid petroleum gas fuel being discharged from the gaseous liquid petroleum gas fuel supply 212, and will therefore receive a supply of the gaseous liquid petroleum gas fuel from the gaseous liquid petroleum gas fuel supply 212 at a predeterminedly desired pressure value. Subsequently, when the portioning valve 220 is disposed at its second position as illustrated within FIG. 3*b*, the portioning valve 220 will be disposed in fluidic communication with the dispensing or discharge orifice 224 of the portioning valve 220 so as to provide the predetermined amount or portion of the gaseous liquid petroleum gas fuel to the dispensing or discharge orifice 224 for conveyance and introduction into the jet pump 226 whereby such gaseous liquid petroleum gas fuel may, in turn, be conveyed into the combustion chamber of the portable power tool.

Figure 4:
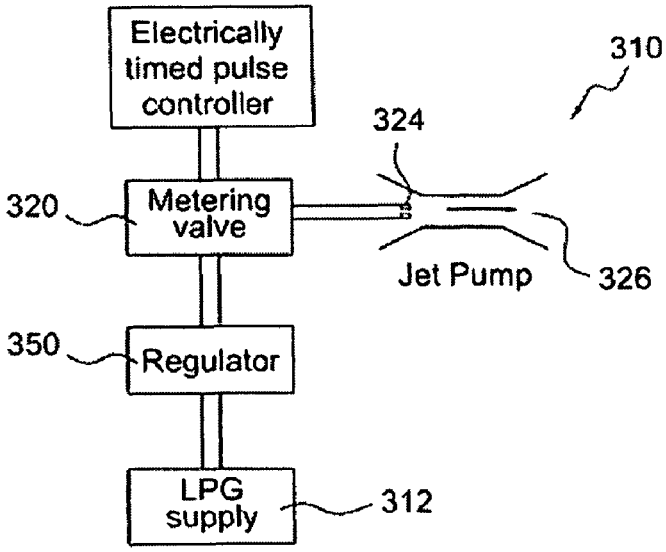
FIG. 4 is a schematic view illustrating a fourth embodiment of the new and improved fuel supply and combustion chamber system for the portable power tool of the present invention which is, in effect, an alternative embodiment with respect to the third embodiment of the new and improved fuel supply and combustion chamber system for the portable power tool as illustrated within FIGS. 3*a* and 3*b*, wherein, in accordance with this alternative or fourth embodiment of the present invention, a metering valve may be utilized for supplying the gaseous liquid petroleum gas fuel toward the jet pump and the combustion chamber of the power tool, and an electrically timed pulse supply controller is operatively associated with the metering valve for effectively converting the metering valve, which effectively determines the flow rate of the fuel passing therethrough, to a portioning valve which effectively determines the amount of the fuel passing therethrough.

With reference now being made to FIG. 4, a fourth embodiment of a new and improved fuel supply and combustion chamber system for a portable power tool, as has been constructed in accordance with the principles and teachings of the present invention, is disclosed and is generally indicated by the reference character 310. As was the case with the second and third embodiment fuel supply and combustion chamber system 110,210 for a portable power tool, as disclosed within FIGS. 2*a*,2*b*, and 3*a*,3*b*, it is likewise to be noted that, in connection with the detailed description of the fourth embodiment fuel supply and combustion chamber system 310 for a portable power tool, the description will focus upon the particular structure characteristic of such fourth embodiment fuel supply and combustion chamber system 310, however, structural components of such fourth embodiment fuel supply and combustion chamber system 310, which are similar or correspond to structural components of the first, second, and third embodiment fuel supply and combustion chamber systems 10,110,210 as disclosed within FIGS. 1,2*a*, 2*b*,3*a*,3*b* will be designated by similar or corresponding reference characters except that they will be within the 300 series. More particularly, the fourth embodiment fuel supply and combustion chamber system 310 substantially comprises modified structure with respect to the second embodiment fuel supply and combustion chamber system 210 in that, in lieu of utilizing the portioning valve 220 in conjunction with the gaseous liquid petroleum gas fuel supply 212 and the pressure regulator 250, a metering valve 320 is utilized in conjunction with a gaseous liquid petroleum gas fuel supply 312 and a pressure regulator 350. It has been noted, however, that a metering valve is not as desirable for usage in conjunction with such combustion systems and power tools as is a portioning valve in that while a metering valve will control the rate at which a particular fuel is dispensed, a metering valve cannot provide a predetermined amount or volume of the dispensed fuel. Therefore, in accordance with the teachings and principles of the present invention, an electrically timed pulse controller 352 is operatively connected to the metering valve 320 so as to effectively convert the metering valve 320 into a portioning valve by controlling the opening and closing of the metering valve at predetermined times such that a predetermined amount or volume of the gaseous liquid petroleum gas fuel from the gaseous liquid petroleum gas fuel supply 312 will be dispensed from the dispensing or discharge orifice 324 toward and into the jet pump 326.

Figure 5A:
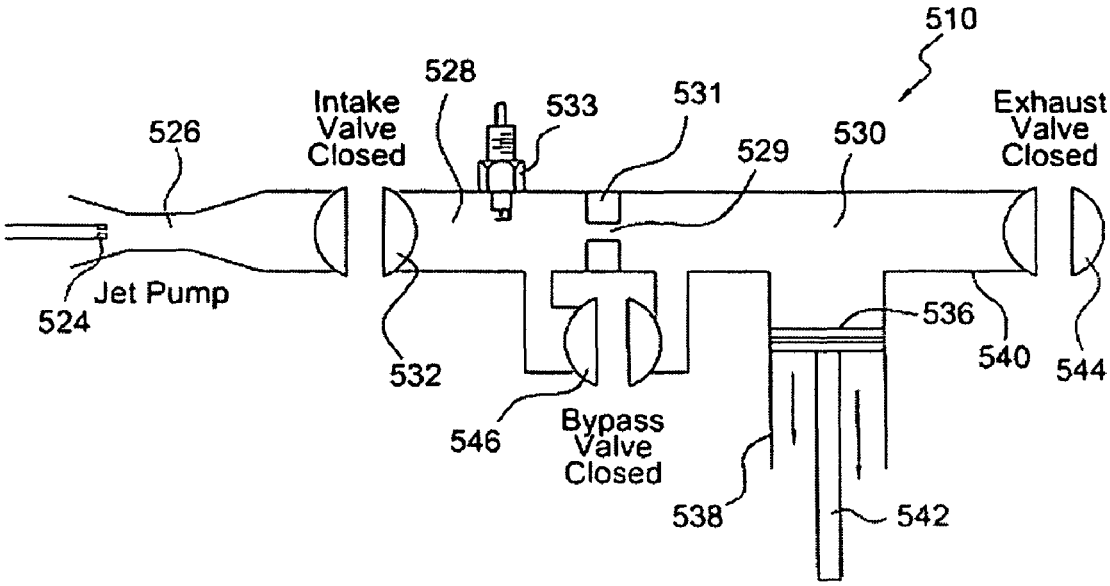
FIGS. 5*a* and 5*b* are schematic views, similar to those of FIGS. 2*a* and 2*b*, showing however a first modified embodiment of the second embodiment of the new and improved fuel supply and combustion chamber system for the portable power tool as illustrated within FIGS. 2*a* and 2*b*, wherein the check valve, interposed between the first pre-combustion chamber and the second main combustion chamber, has effectively been eliminated so as to permit constant or permanent communication between the first pre-combustion chamber and the second main combustion chamber by means of the orifice fluidically connecting the first pre-combustion chamber and the second main combustion chamber together.
Figure 5B:
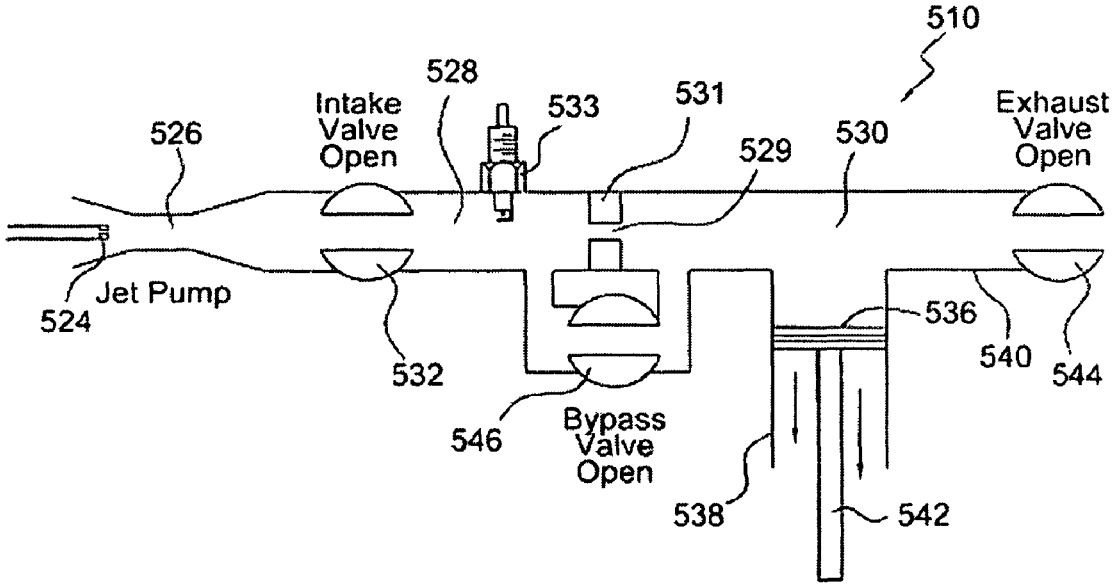

With reference now being made to FIGS. 5*a* and 5*b*, a first modified embodiment of the second embodiment of the new and improved fuel supply and combustion chamber system for the portable power tool 110, as illustrated within FIGS. 2*a* and 2*b*, is disclosed and is generally indicated by the reference character 510. It is noted that, in connection with the detailed description of this first modified embodiment of the second embodiment fuel supply and combustion chamber system for the portable power tool 510, the description will focus upon the particular structure characteristic of this first modified embodiment of the second embodiment fuel supply and combustion chamber system 510 and how the same differs from that of the second embodiment of the new and improved fuel supply and combustion chamber system for the portable power tool 110 as illustrated within FIGS. 2*a* and 2*b*. In addition, it is also noted that the structural components of this first modified embodiment of the second embodiment fuel supply and combustion chamber system 510, which are similar or correspond to the structural components of the second embodiment fuel supply and combustion chamber system 110 as disclosed within FIGS. 2*a* and 2*b*, will be designated by similar or corresponding reference characters except that they will be within the 500 series.

More particularly, it is seen that in accordance with the principles and teachings of this first modified embodiment of the second embodiment fuel supply and combustion chamber system 110, the check valve 134, which was interposed between the first pre-combustion chamber 128 and the second main combustion chamber 130, has been eliminated so as to permit constant or permanent fluidic communication between the first pre-combustion chamber 528 and the second main combustion chamber 530 by means of the orifice 529 which is defined within the wall member 531 which separates the first pre-combustion chamber 528 from the second main combustion chamber 530. By eliminating the check valve 134 and permitting the constant or permanent fluidic communication to exist between the first pre-combustion chamber 528 and the second main combustion chamber 530, the free flow of the combusted air-fuel mixture within the pre-combustion chamber 528 is able to cause desired turbulence within main combustion chamber 530, as is desired in connection with the operation of some portable power tools, and in addition, it can also be appreciated that the total volumetric capacity of the multiple combustion chambers is effectively increased thereby advantageously affecting air-fuel mixture ratios as well as the vacuum volume and return stroke characteristics of the tool upon completion of a fastener firing cycle, which is also desirable in connection with the operation of particular types of power tools.

Figure 6:
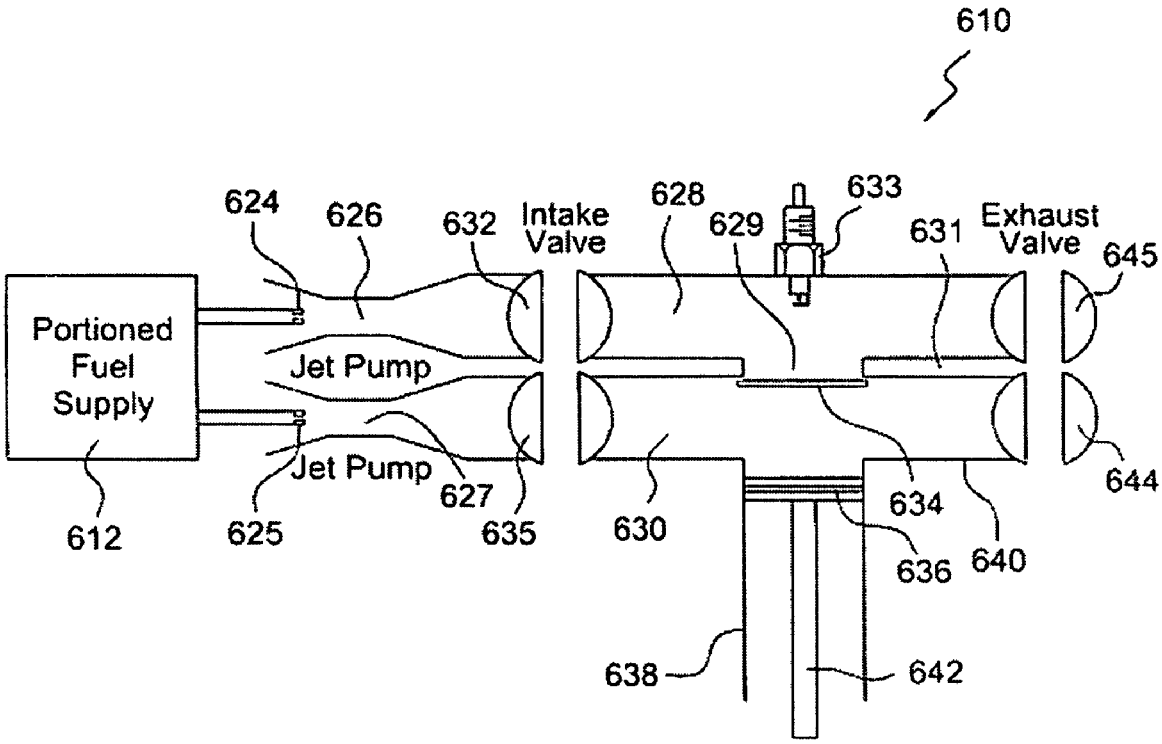
FIG. 6 is a schematic view, also similar to those of FIGS. 2*a* and 2*b*, or FIGS. 5*a* and 5*b*, showing however a second modified embodiment of the second embodiment of the new and improved fuel supply and combustion chamber system for a portable power tool as disclosed within FIGS. 2*a* and 2*b*, wherein while both the first pre-combustion chamber and the second main combustion chamber are fluidically connected together by means of the aforenoted check valve, the bypass valve is effectively eliminated and the first pre-combustion chamber and the second main combustion chamber are respectively provided with separate fuel supplies, separate intake valves, and separate exhaust valves.

Turning now to FIG. 6, a second modified embodiment of the second embodiment of the new and improved fuel supply and combustion chamber system for the portable power tool 110, as illustrated within FIGS. 2*a* and 2*b*, is disclosed and is generally indicated by the reference character 610. It is noted that, in connection with the detailed description of this second modified embodiment of the second embodiment fuel supply and combustion chamber system 110 for the portable power tool, the description will focus upon the particular structure characteristic of this second modified embodiment of the second embodiment fuel supply and combustion chamber system 610 and how the same differs from that of the second embodiment of the new and improved fuel supply and combustion chamber system for the portable power tool 110 as illustrated within FIGS. 2*a* and 2*b*. In addition, it is also noted that the structural components of this second modified embodiment of the second embodiment fuel supply and combustion chamber system 610, which are similar or correspond to the structural components of the second embodiment fuel supply and combustion chamber system 110 as disclosed within FIGS. 2*a* and 2*b*, will be designated by similar or corresponding reference characters except that they will be within the 600 series.

It is initially noted, in connection with the second modified embodiment of the second embodiment of the fuel supply and combustion chamber system for the portable power tool 610, that in lieu of the substantially serial array of the first pre-combustion and second main combustion chambers 128,130, as is characteristic of the second embodiment fuel supply and combustion chamber system for the port-able power tool 110 as illustrated within FIGS. 2*a* and 2*b*, wherein, for example, the air-fuel mixture is conducted into the upstream end portion of the first pre-combustion chamber 128 from the discharge orifice 124 and through the jet pump 126 and the intake valve assembly 132, and subsequently, the air-fuel mixture is conducted into the second main combustion chamber 130 by means of the bypass valve assembly 146, while exhaust gases and residual combustion products are exhausted or purged through means of the exhaust valve assembly 144, in accordance with the principles and teachings of the second modified embodiment of the second embodiment fuel supply and combustion chamber system 610, the first pre-combustion and second main combustion chambers 628,630 are effectively arranged in a hybrid manner with respect to each other.

More particularly, while the first pre-combustion and second main combustion chambers 628,630 are, in effect, serially connected to each other in that they are fluidically connected together by means of the orifice 629 and the check valve 634, the first pre-combustion and second main combustion chambers 628,630 are also, in effect, connected to each other in a parallel mode in that the first pre-combustion and second main combustion chambers 628,630 are respectively provided with their own separate intake valves 632,635 and their own separate exhaust valves 644,645. In addition, the first pre-combustion and second main combustion chambers 628,630 are also provided with their own separate fuel discharge or dispensing orifices 624,625 for discharging or dispensing separate charges of fuel, from a common metered fuel supply 612, into separate jet pumps 626,627. It is also noted that the bypass valve assembly 146 of the second embodiment fuel supply and combustion chamber system 110 has been eliminated, and still further, as a result of this particular structural arrangement characteristic of the second modified embodiment of the second embodiment fuel supply and combustion chamber system 610, the portable tool is able to be provided with different air-fuel mixtures and power output parameters as may be desired. Still yet further, by providing the pre-combustion and main combustion chambers 628,630 with their own fuel supplies 624,625 and jet pumps 626,627, intake valves 632,635, exhaust valves 644, 645, the speed of operation, favorable pressure parameters, and reduced downstream resistance characteristics can be achieved.

Figure 7:
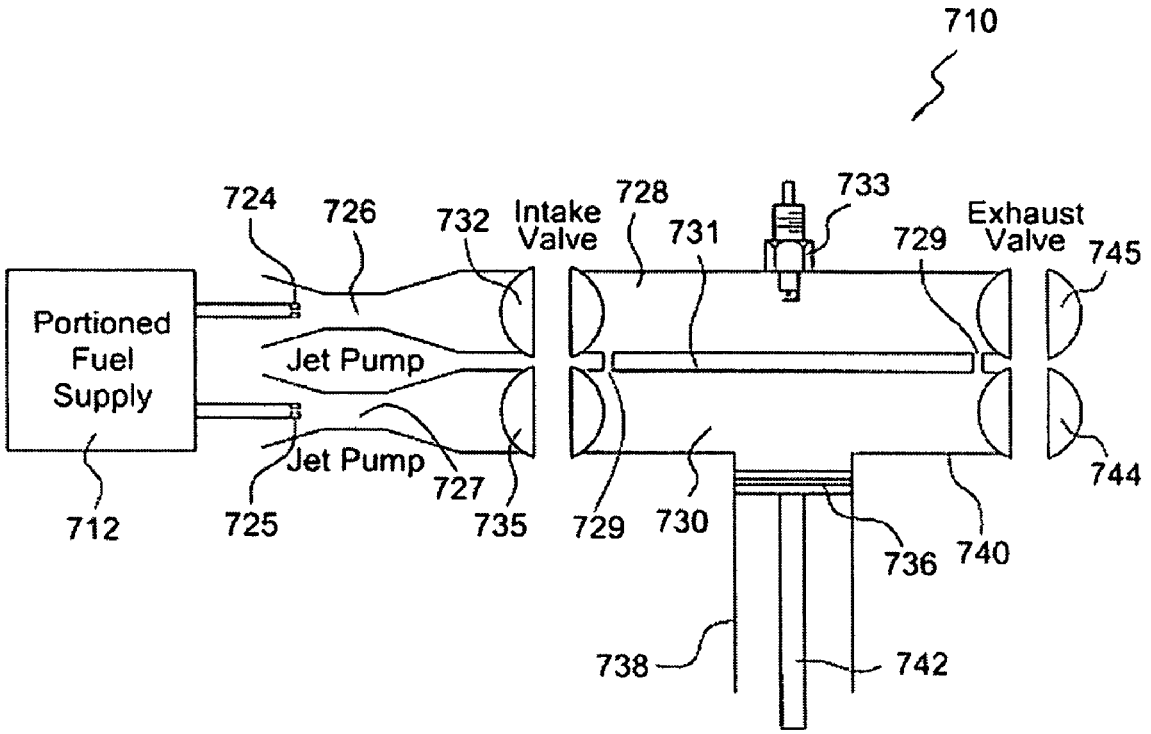
FIG. 7 is a schematic view, similar to that of FIG. 6, showing however a third modified embodiment of the second embodiment of the new and improved fuel supply and combustion chamber system for a portable power tool as disclosed within FIGS. 2*a* and 2*b*, wherein in lieu of the first pre-combustion chamber and the second main combustion chamber being fluidically connected together by means of the aforenoted orifice and check valve, the check valve has effectively been eliminated and the first pre-combustion chamber and the second main combustion chamber are fluidically connected together by means of one or more orifices.

With reference now being made to FIG. 7, a third modified embodiment of the second embodiment of the new and improved fuel supply and combustion chamber system for the portable power tool 110, as illustrated within FIGS. 2*a* and 2*b*, wherein such third modified embodiment system is also a modified embodiment of the second modified embodiment fuel supply and combustion chamber system 610 as disclosed within FIG. 6, is disclosed and is generally indicated by the reference character 710. It is to be noted that, in connection with the detailed description of this third modified embodiment of the second embodiment fuel supply and combustion chamber system 110 for the portable power tool, as well as its modifications with respect to the second modified embodiment fuel supply and combustion chamber system 610 as disclosed within FIG. 6, the description will focus upon the particular structure characteristic of this third modified embodiment of the second embodiment fuel supply and combustion chamber system 710 and how the same differs, for example, from that of the second modified embodiment of the new and improved fuel supply and combustion chamber system for the portable power tool 610 as illustrated within FIG. 6. In addition, it is also noted that the structural components of this third modified embodiment of the second embodiment fuel supply and combustion chamber system 710, which are similar to the second modified embodiment of the new and improved fuel supply and combustion chamber system for the portable power tool 610 as illustrated within FIG. 6, will be designated by similar or corresponding reference characters except that they will be within the 700 series.

More particularly, it is seen that the only significant difference between the third modified embodiment of the fuel supply and combustion chamber system 710, as illustrated within FIG. 7, and the second modified embodiment of the fuel supply and combustion chamber system 610, as illustrated within FIG. 6, resides in the fact that, in lieu of the first pre-combustion chamber 728 and the second main combustion chamber 730 being fluidically connected together by means of the aforenoted orifice and check valve 634, as illustrated in connection with the second modified embodiment of the fuel supply and combustion chamber system 610, the check valve 634 has effectively been eliminated and the first pre-combustion chamber 728 and the second main combustion chamber 730 are fluidically connected together by means of one or more orifices 729.

It is also to be appreciated that the third modified embodiment of the fuel supply and combustion chamber system 710, as illustrated in FIG. 7, when compared to the second modified embodiment of the fuel supply and combustion chamber system 610, as illustrated within FIG. 6, is similar to the first modified embodiment of the fuel supply and combustion chamber system 510, as illustrated within FIGS. 5*a* and 5*b*, when compared to the second embodiment of the fuel supply and combustion chamber system 210 as illustrated within FIG. 2, in that the check valve of the second embodiment of the fuel supply and combustion chamber system 210 has been eliminated from the first modified embodiment of the fuel supply and combustion chamber system 510. As was the case with the first modified embodiment of the fuel supply and combustion chamber system 510, the elimination of the check valve within the third modified embodiment of the fuel supply and combustion chamber system 710 permits the total volumetric capacity of the multiple combustion chambers to effectively be increased thereby advantageously affecting air-fuel mixture ratios as well as the vacuum volume and return stroke characteristics of the tool upon completion of a fastener firing cycle.

Figure 8A:
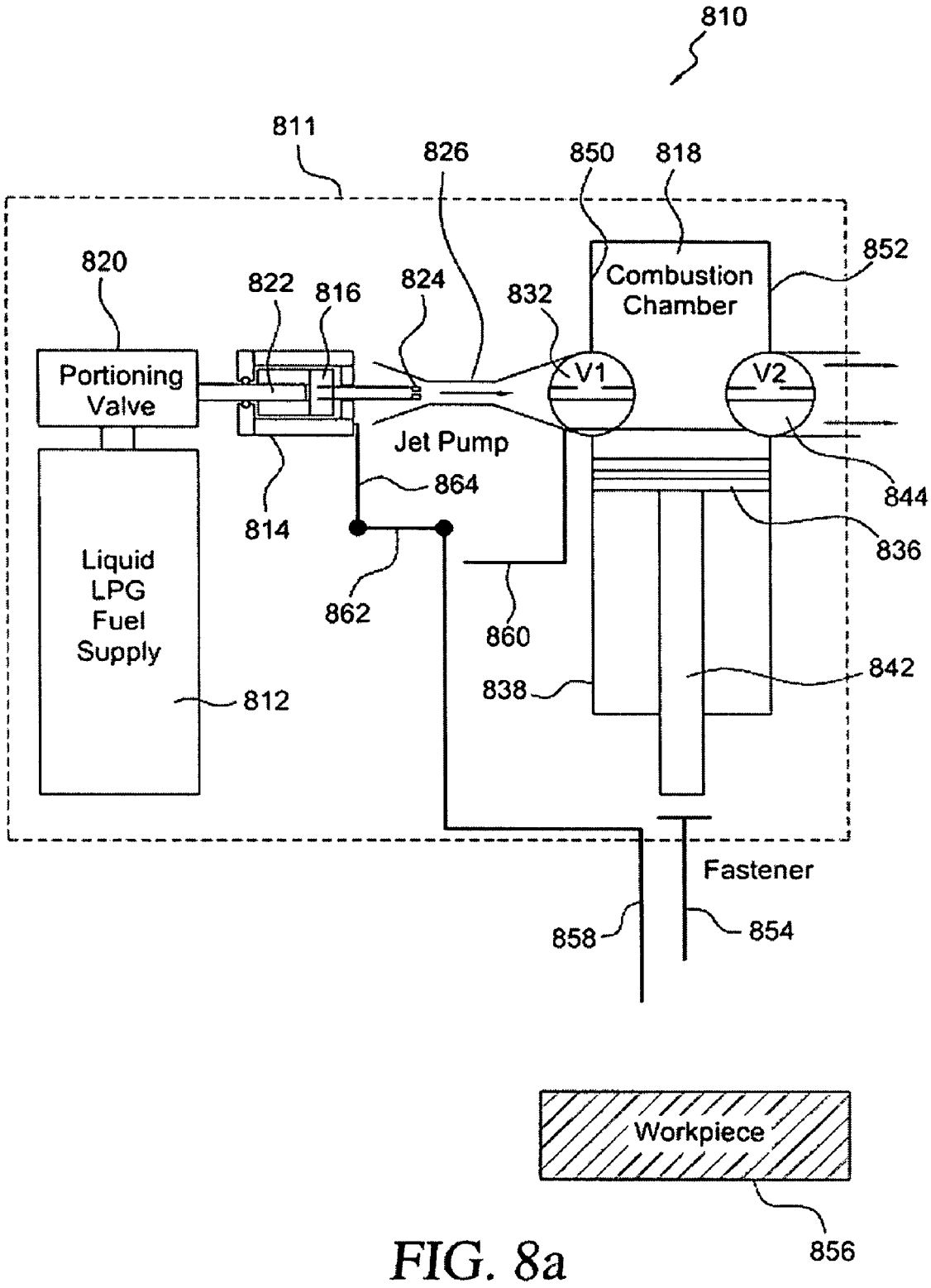
FIGS. 8*a*-8*c* are schematic views of a first modified embodiment of the first embodiment of the new and improved fuel supply and combustion chamber system for the portable power tool as illustrated within FIG. 1 wherein the portioning valve is operatively controlled by means of a workpiece contact element which is mounted upon the power tool so as to be adapted to be engaged with, or disengaged from, a workpiece into which a fastener is to be driven, and wherein further, the trigger mechanism of the power tool is operatively connected to the intake and exhaust valves of the combustion chamber as well as to a piezoelectric spark generator.
Figure 8B:
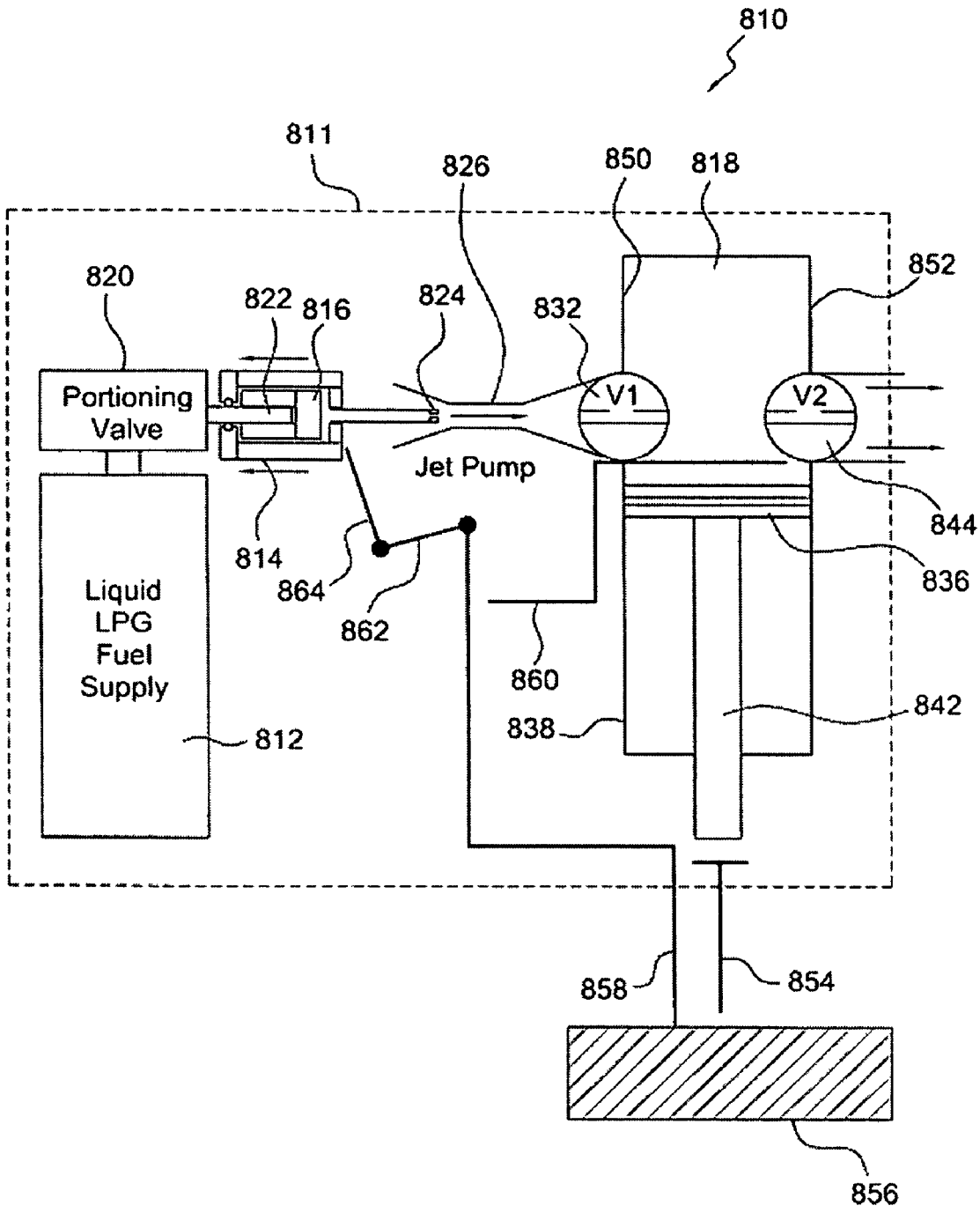
Figure 8C:
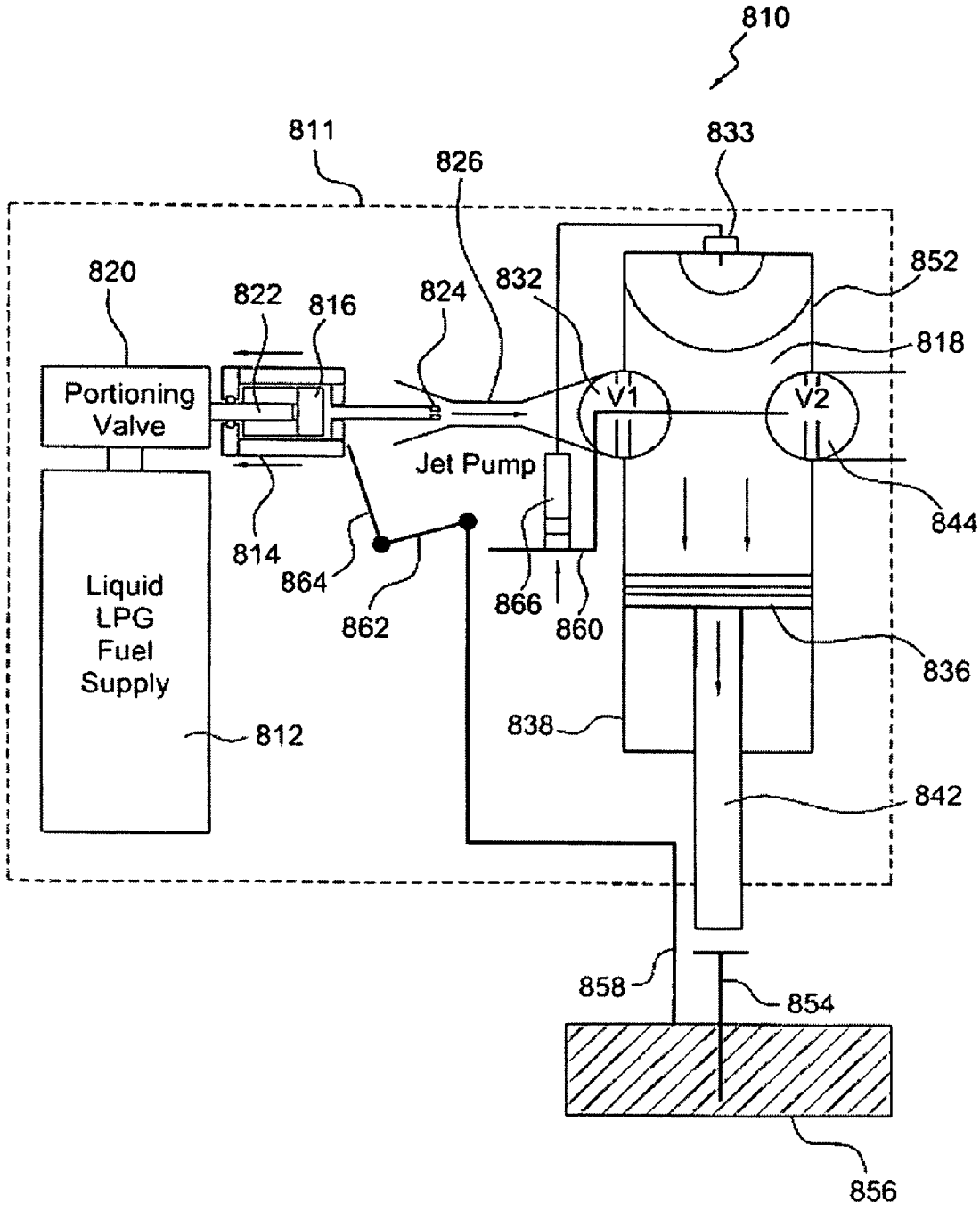

Turning now to FIGS. 8*a*-8*c*, a first modified embodiment of the first embodiment of the new and improved fuel supply and combustion chamber system for the portable power tool 10, as illustrated within FIG. 1, is disclosed and is generally indicated by the reference character 810. It is to be noted that, in connection with the detailed description of this first modified embodiment of the first embodiment fuel supply and combustion chamber system for the portable power tool 810, the description will focus upon the particular structure characteristic of this first modified embodiment of the first embodiment fuel supply and combustion chamber system for the portable power tool 810 and how the same differs, for example, from that of the first modified embodiment of the first embodiment fuel supply and combustion chamber system for the portable power tool 10 as illustrated within FIG. 1. In addition, it is also noted that the structural components of this first modified embodiment of the first embodiment fuel supply and combustion chamber system for the portable power tool 810, which are similar to the first embodiment fuel supply and combustion chamber system for the portable power tool 10 as illustrated within FIG. 1, will be designated by similar or corresponding reference characters except that they will be within the 800 series. More particularly, it is seen, for example, within any one of FIGS. 8*a*-8*c*, that the portable power tool 811 is provided with a combustion chamber 818, and that a pair of intake and exhaust valves 832,844 are incorporated within oppositely disposed wall members 850, 852 of combustion chamber 818 so as to be movable between OPEN and CLOSED positions as respectively illustrated, for example, within FIGS. 8*a* and 8*c*. In addition, a working piston 836 is movably mounted in a working cylinder 838, and a fastener driving blade 842 is secured to the underside portion of the working piston 836. Accordingly, when the working piston 836 undergoes a downward working stroke as a result of combustion initiated within the combustion chamber 818 upon commencement of a fastener-driving cycle, the fastener driving blade 842 will drive a fastener 854 into a workpiece 856. It is also seen that the power tool 811 comprises a nose-mounted workpiece contact element 858 and a trigger mechanism 860. In accordance with the principles and teachings of the present invention, it is seen that the nose-mounted workpiece contact element 858 is operatively connected, by means of first and second linkage members 862, 864, to the evaporator assembly 814 which is operatively associated with the portioning valve 820, and that the trigger mechanism 860 is operatively connected to the intake and exhaust valves 832,844 as well as to a piezoelectric spark generator 866 which is electrically connected to the spark plug 833 as can best be seen in FIG. 8*c*.

Accordingly, when a fastener-driving operation is to be implemented, the workpiece contact element 858 of the portable power tool 811 is initially disposed into contact with the workpiece 856, the portable power tool 811 is effectively moved downwardly toward the workpiece 856 so as to effectively force the work-piece contact element 858 to move upwardly with respect to the portable power tool 811, and as a result of such upward movement of the workpiece contact element 858 with respect to the portable power tool 811, the evaporator assembly 814 is caused to move toward the portioning valve 820, through means of the linkage members 862,864, so as to cause the portioning valve 820 to discharge or dispense a predetermined amount of fuel into the evaporator assembly 814, all as can best be appreciated from FIG. 8*b*. Subsequently, upon being evaporated by means of the sintered bronze element 816 of the evaporator assembly 814, the gaseous fuel is then injected into the jet pump 826 from the discharge orifice 824 of the evaporator assembly 814 whereby, in turn, the air-fuel mixture is conducted into the tool combustion chamber 818 through means of the intake valve 832 which is disposed at its OPEN position as can also be seen in FIG. 8*b*. Subsequently still further, and as can best be appreciated from FIG. 8*c*, when the trigger mechanism 860 is pulled or moved upwardly, the intake and exhaust valves 832, 844 are moved to their CLOSED positions, and in addition, the trigger mechanism 860 actuates the piezoelectric spark generator 866 so as to cause the spark plug 833 to initiate combustion within the combustion chamber 818. As a result of the combustion process, output power is effectively delivered to the working piston and driving blade assembly 836,842 whereby the fastener 854 is driven into the workpiece 856 as illustrated within FIG. 8*c*.

Figure 9:
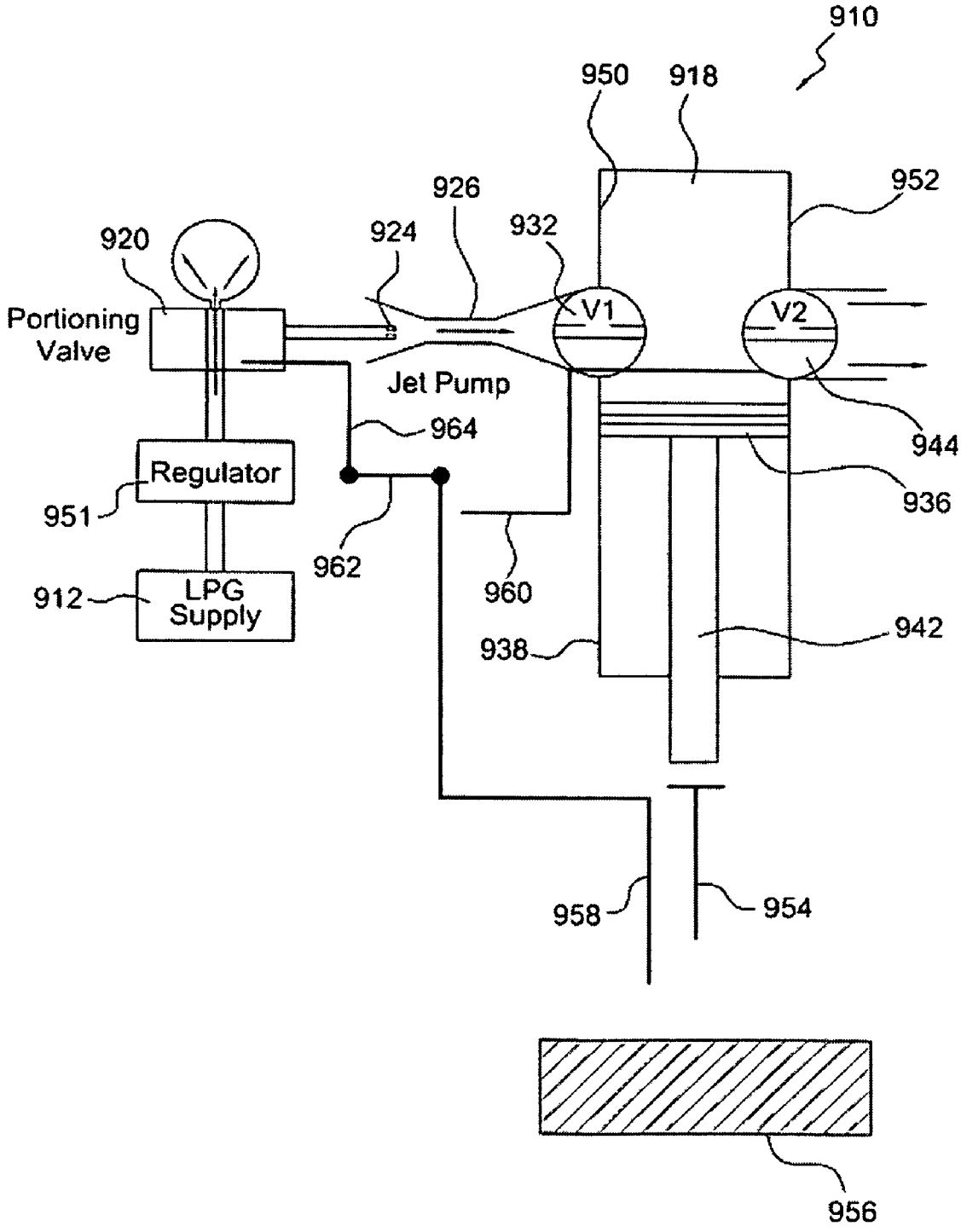
FIG. 9 is a schematic view, similar to that of FIG. 8*a*, showing, however, a modified embodiment of the fuel supply and combustion chamber system for the portable power tool, as illustrated within FIG. 8*a*, wherein the fuel supply for the portable power tool comprises a gaseous liquid petroleum gas fuel supply as controlled by means of a portioning valve mechanism.

With reference lastly being made to FIG. 9, a modified embodiment of the fuel supply and combustion chamber system for the portable power tool 810, as illustrated within FIG. 8*a*, is disclosed and is generally indicated by the reference character 910. It is to be noted that, in connection with the detailed description of this modified embodiment of the fuel supply and combustion chamber system for the portable power tool 910, the description will focus upon the particular structure characteristic of this modified embodiment of the fuel supply and combustion chamber system for the portable power tool 910 and how the same differs, for example, from that of the fuel supply and combustion chamber system for the portable power tool 810 as illustrated within FIG. 8*a*.

In addition, it is also noted that the structural components of this modified embodiment of the fuel supply and combustion chamber system for the portable power tool 910, which are similar to the fuel supply and combustion chamber system for the portable power tool 810 as illustrated within FIG. 8*a*, will be designated by similar or corresponding reference characters except that they will be within the 900 series. More particularly, it is noted that the only significant difference, between the fuel supply and combustion chamber system for the portable power tool 910 and the fuel supply and combustion chamber system for the portable power tool 810, resides in the fact that in lieu of the liquid fuel supply and portioning valve system 812,820, along with the evaporator 814, as utilized within the fuel supply and combustion chamber system for the portable power tool 810, the fuel supply and combustion chamber system for the portable power tool 910 utilizes a gaseous fuel supply 912, a regulator 951, and a portioning valve 920, wherein such operative components are similar to those employed within the third embodiment fuel supply and combustion chamber system for the portable power tool 210 as illustrated within FIGS. 3*a* and 3*b*.

Thus, it may be seen that in accordance with the principles and teachings of the present invention, there has been provided several different embodiments of new and improved fuel supply and combustion chamber systems for portable power tools, such as, for example, fastener-driving tools, wherein the fuel supply and combustion chamber system can utilize a liquid fuel and an evaporator in conjunction therewith. In addition, the fuel supply and combustion chamber system can comprise multiple combustion chamber systems, for achieving predetermined combustion and power output characteristics or parameters, in conjunction with an exhaust gas scavenging or purging bypass mechanism interposed between the first and second pre-combustion and main combustion chambers. Still further, the fuel supply and combustion chamber systems can utilize portioning valve structures for providing predetermined volumes or amounts of either a gaseous or liquid fuel into the portable power tool combustion chambers. Lastly, the tool workpiece contact elements are operatively connected to the portioning valves, and the trigger mechanisms are operatively connected to the intake and exhaust valves, and to a piezoelectric spark generator, for initiating the combustion cycle when a fastener-driving operation is to be performed.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A fuel supply and combustion chamber system for use within a power tool, comprising:

a combustion chamber;

a liquid fuel supply containing a supply of liquid fuel;

a valve fluidically connected to said liquid fuel supply for dispensing a predetermined amount of said liquid fuel from said liquid fuel supply;

an evaporator fluidically connected at a first end portion thereof to said valve for converting said predetermined amount of said liquid fuel, dispensed by said valve, into a gaseous fuel, and fluidically connected at a second end portion thereof to said combustion chamber for supplying said gaseous fuel to said combustion chamber;

a workpiece contact element operatively connected to said valve so as to cause said valve to dispense said predetermined amount of said liquid fuel from said liquid fuel supply when said workpiece contact element is disposed in contact with a workpiece;

intake and exhaust valves operatively associated with said combustion chamber;

an ignition device operatively associated with said combustion chamber; and a trigger mechanism, movably mounted upon said power tool and operatively connected to said ignition device and said intake and exhaust valves, so as to activate said ignition device in order to initiate combustion of said air-fuel mixture within said combustion chamber, and to move said intake and exhaust valves to CLOSED positions, when said trigger mechanism is actuated so as to initiate a power tool firing cycle.

2. A fuel supply and combustion chamber system for use within a power tool, comprising:

a pre-combustion chamber;

a main combustion chamber fluidically connected to said pre-combustion chamber;

a fuel supply for supplying fuel into said pre-combustion chamber;

a jet pump interposed between said fuel supply and an upstream end portion of said pre-combustion chamber for entraining air into said fuel supply so as to define an air-fuel mixture, having a predetermined stoichiometric ratio, to be introduced into said pre-combustion chamber;

an intake valve interposed between said jet pump and said upstream end portion of said pre-combustion chamber, and movably disposed between first OPEN and second CLOSED positions;

an orifice interposed between said pre-combustion chamber and said main combustion chamber for fluidically connecting said pre-combustion chamber to said main combustion chamber;

an exhaust valve operatively associated with a downstream end of said main combustion chamber and movably disposed between first OPEN and second CLOSED positions; and a bypass valve interposed between said pre-combustion chamber and said main combustion chamber and movably disposed between first OPEN and second CLOSED positions such that when said bypass valve, said intake valve, and said exhaust valve are disposed at said first OPEN positions, an air-fuel mixture can flow into and through said pre-combustion chamber, through said bypass valve, through said main combustion chamber, and out through said exhaust valve so as to charge an air-fuel mixture into said pre-combustion and main combustion chambers as well as to scavenge exhaust combustion products out from said pre-combustion and main combustion chambers, while when said by-pass valve, said intake valve, and said exhaust valve are disposed at said CLOSED positions, said air-fuel mixture disposed within said pre-combustion and main combustion chambers is effectively trapped within said pre-combustion and main combustion chambers so as to be ready for ignition.

3. The fuel supply and combustion chamber system as set forth in claim 2, further comprising:

a check valve operatively associated with said orifice interposed between said pre-combustion chamber and said main combustion chamber for controlling the fluidic connection of said pre-combustion chamber to said main combustion chamber when a relatively high predetermined pressure level is attained within said pre-combustion chamber during a combustion cycle.

4. The fuel supply and combustion chamber system as set forth in claim 2, wherein:

said main combustion chamber is fluidically connected to a downstream end portion of said pre-combustion chamber.

5. A fuel supply and combustion chamber system for use within a power tool, comprising:

a pre-combustion chamber;

a main combustion chamber fluidically connected to said pre-combustion chamber;

a pair of fuel supply dispensers fluidically connected respectively to said pre-combustion chamber and said main combustion chamber for supplying fuel into said pre-combustion chamber and said main combustion chamber;

a pair of jet pumps respectively interposed between said pair of fuel supply dispensers and said pre-combustion and main combustion chambers for respectively entraining air into said fuel supplies from said pair of fuel supply dispensers so as to define air fuel mixtures to be introduced into said pre-combustion and main combustion chambers;

an orifice interposed between said pre-combustion chamber and said main combustion chamber for fluidically connecting said pre-combustion chamber to said main combustion chamber;

a pair of intake valves respectively interposed between said pair of jet pumps and upstream end portions of said pre-combustion and main combustion chambers, and movably disposed between first OPEN and second CLOSED positions; and a pair of exhaust valves respectively operatively associated with downstream end portions of said pre-combustion and main combustion chambers and movably disposed between first OPEN and second CLOSED positions, such that when said pair of intake valves and said pair exhaust valves are disposed at said first OPEN positions, air-fuel mixtures can flow through said pair of intake valves, into, through, and out from said pre-combustion chamber, said main combustion chamber, and said pair of exhaust valves, so as to charge air-fuel mixture into said pre-combustion and main combustion chambers as well as to scavenge exhaust combustion products out from said pre-combustion and main combustion chambers, while when said pair of intake valves and said pair of exhaust valves are disposed at said CLOSED positions, said air-fuel mixtures disposed within said pre-combustion and main combustion chambers are effectively trapped within said pre-combustion and main combustion chambers so as to be ready for ignition.

6. The fuel supply and combustion chamber system as set forth in claim 5, further comprising:

a check valve operatively associated with said orifice interposed between said pre-combustion chamber and said main combustion chamber for controlling the fluidic connection of said pre-combustion chamber to said main combustion chamber when a relatively high predetermined pressure level is attained within said pre-combustion chamber during a combustion cycle.

7. The fuel supply and combustion chamber system as set forth in claim 5, wherein:

said fuel supply and combustion chamber system comprises a hybrid system in that said pre-combustion chamber and said main combustion chamber are serially connected together by said orifice and yet are disposed parallel with respect to each other by said pair of fuel supply dispensers, said pair of jet pumps, said pair of intake valves, and said pair of exhaust valves.

8. The fuel supply and combustion chamber system as set forth in claim 5, wherein:

said pre-combustion chamber is disposed atop said main combustion chamber.

9. The fuel supply and combustion chamber system as set forth in claim 1, wherein:

said workpiece contact element is operatively connected to said valve by linkage mechanisms.

10. The fuel supply and combustion chamber system as set forth in claim 1, wherein:

said trigger mechanism is operatively connected to said ignition device and said intake and exhaust valves by linkage mechanisms.

* * * * *